US005454339A

United States Patent [19]

Hall

[11] Patent Number: 5,454,339

[45] Date of Patent: Oct. 3, 1995

[54] APPARATUS FOR BI-LATERAL SAIL SHEETING

[76] Inventor: Wallace E. Hall, 7361 S. Quince St., Englewood, Colo. 80112

[21] Appl. No.: 240,830

[22] Filed: May 11, 1994

[51] Int. Cl.[6] ..... B63H 9/10

[52] U.S. Cl. ..... 114/39.1; 114/43; 114/102

[58] Field of Search ..... 114/102, 39.1, 114/43, 204, 103, 111

[56] References Cited

U.S. PATENT DOCUMENTS

| | | | |
|---|---|---|---|
| 3,026,121 | 3/1962 | Ellam | 280/16 |
| 3,212,109 | 10/1965 | Roman | 114/39.1 X |
| 3,390,656 | 7/1968 | Flowers | 114/39 |
| 3,489,423 | 1/1970 | Easton | 114/43 |
| 3,678,876 | 7/1972 | Alter | 114/102 |
| 3,707,935 | 1/1973 | Rachle | 114/39 |
| 3,859,943 | 1/1975 | Katainen | 114/39 |
| 4,013,031 | 3/1977 | Viviano | 114/102 |
| 4,437,426 | 3/1984 | Latham | 114/103 |
| 4,671,201 | 6/1987 | Yokoyama | 114/204 X |
| 4,873,934 | 10/1989 | Renault | 114/39.1 |
| 5,038,694 | 8/1991 | Yamada | 114/39.1 |
| 5,168,824 | 12/1992 | Ketterman | 114/276 |
| 5,285,742 | 2/1994 | Anderson | 114/43 |

FOREIGN PATENT DOCUMENTS

| | | | |
|---|---|---|---|
| 2110622 | 6/1983 | United Kingdom | 114/102 |

*Primary Examiner*—Sherman Basinger

[57] ABSTRACT

A method and apparatus for sheeting a sail of a sailing vessel having the sail rotatably attached to a mast mounted on a vessel body. The apparatus includes a main sheet line wherein opposite ends of the main sheet line are attached to the rotating portion of the sail. The main sheet line is received around pulleys mounted on opposite sides of the vessel or on a lateral beam extending outwardly from the vessel body. One end of a secondary sheet line is attached to the main sheet line at the center of the vessel when the sail is fully sheeted in. The secondary sheet line is laterally constrained by the centering pulleys yet may freely run between the pulleys. The secondary sheet line extends from the centering pulleys and around a forward pulley to the vessel skipper. By pulling the single secondary sheet line, the skipper can operate the main sheet line and sheet the sail.

11 Claims, 5 Drawing Sheets

APPARATUS FOR BI-LATERAL SAIL SHEETING

BACKGROUND—FIELD OF INVENTION

This invention relates to a new method and apparatus for sheeting the sail of an ice boat or sail boat. The method and apparatus allows efficient and high performance sheeting of a sail board type sail with a rigid upright mast mount configuration.

The term 'sheet' refers to the act of pulling the end of a sail towards the center of the vessel so that the sail becomes more parallel to the lengthwise dimension of the vessel. The amount of sheeting controls the power in the sail and hence, the speed of the vessel.

Typical sail boats for use on either ice or water use a main sail sheeting method which has been around for many years. This sheeting method works by having a pulley system attached to a point near the center of the vessel body and a point on the sail boom. The main sheet line is looped through this pulley system. When the main sheet line is pulled, the distance between the vessel attachment point and the boom attachment point is reduced. This produces both a downward and lateral force on the sail. As the sail becomes closer to being fully sheeted in to the center point, the force from the main sheet becomes more and more downward. This works well with conventional sails at lower speeds as a lateral and downward force is required to keep the shape of the sail and both of these forces act to control the performance of the sail.

Sail board type sails which are sometimes called 'Windsurfing' sails, have a different construction than conventional sail boat sails. The sail board type sail has a boom mounted to the mast about 4 to 5 feet above the bottom of the sail. This is about arm-shoulder height when mounted on a sail board. The boom holds the shape of the sail along with the down-haul tension by design, as the sail board sail is mounted to a sail board at only one pivoting location. This is in contrast to a conventional sail which requires main sheet tension to hold the shape of the sail.

Conventional sheeting methods work poorly with sail board type sails in a free standing rigid mount configuration. Since a sail board sail holds its own shape and the boom is mounted significantly above the mast base, conventional sheeting methods provide too much downward force and not enough lateral force. In additions a conventional sheeting method will not allow full sheeting to center of a sail board type sail or even a conventional sail as the downward force begins to dominate when the sail gets near the maximum sheeting location. This has the disadvantage on high speed sailing vessels such as ice boats because at vessel speeds two to three times the wind speed, the apparent wind clocks around to the front of the vessel and the top speed is in part determined by how close to center the sail can be sheeted. The downward force of the sheet also has the disadvantage of tightening the leech of the sail thus not allowing the sail to properly spill wind during gusts.

The prior art for sheeting a sail board type sail, other than the standard use of the boom being hand sheeted by the skipper standing on a sail board, has involved using a long pole attached to the body of the sailing vessel. The end of the pole is located near the boom of the sail. A line from near the end of the pole to the boom end can be shortened by the skipper. This allows the sheeting force to be lateral. However, this has the disadvantage of cost and design complexity as the pole must be very strong because of the significant forces involved. The necessary strength requirement for the pole results in heavyweight or high cost for exotic material.

The applicant of this patent is not aware of any prior art or patents which are fundamentally similar to this invention.

Objects and Advantages

It is an object of this invention to very simply and cost effectively solve the problem of lateral sheeting for a rigidly mounted sail board type sail. In addition, it is an object of this invention to allow a sail board type sail to be placed behind the boat skipper without excessive boat length. The benefits of the rear sail location are:

1) The skipper does not have to duck under the sail during a direction change.
2) Because the sail does not need to clear the skipper, it can be lower to the ice or water. This lowers the center of force on the sail leading to greater stability. Also, the gap at the bottom of the sail can be very small thereby reducing turbulence and increasing power and speed from the sail. This is referred to as 'closing the gap' in the sail board industry.

Conventional sheeting methods pull down from a center point on the vessel behind the mast. This has the disadvantage of never being able to fully sheet the sail to center because as the boom nears the centers the downward force of the sheet dominates the lateral force of the sheet. Therefore, it is an object of this invention to allow full sheeting to center since the sheeting force can come from the far sides of the vessel rather than the center.

Finally, it is an object of this invention to allow a sail board type sail to be used in a very simple and inexpensive manner on an ice or water vessel with the sail mounted behind or in front of the skipper° This has the advantage of appealing to an existing market consisting of sail boarders who already own sail board sails and rigs. Also, this type of sail has undergone extensive performance refinements and has the cost advantage of economies of scale.

Further objects and advantages of this invention will become apparent from a consideration of the drawings and ensuing description.

List of Figure Reference Numerals

FIGS. 1,2,3,3A,4,5

10—Center pulley assembly.

12—Main sheet line.

14—Lateral end pulley for main sheet°

16—Main-secondary sheet attachment point.

18—Sheet line guide.

20—Sheeting point.

22—Sail.

24—Boom.

26—Seat location in front of the sail.

28—Guy wire for holding mast and sail in place. There are three total.

30—Ice rail. Steel or aluminum interface between the vessel and the ice surface. There are three total.

32—Mast

34—Main rear body cross beam of vessel (ice boat in this example).

36—Vessel main body section.

38—Front pulley's for directing secondary sheet line to vessel skipper.

40—Rear pulley for 2:1 leverage.

42—Secondary sheet line.

44—Knot in main sheet rope for attachment of secondary sheet line at point 16.

46—Loop in secondary sheet line 42 for attachment to main sheet line 12.

48—Right side sheet adjustment line.

50—Left side sheet adjustment line.

52—Mast brace

DESCRIPTION OF INVENTION IN THE PREFERRED EMBODIMENT

This invention is a sail sheeting method. The description given here shows how this invention is used in a ice boat utilizing a sail board type sail mounted behind the skipper of the boat. Controlling an ice boat generally involves adjusting the sheet and steering. The main description in this specification involves the method for sheeting the sail. The steering mechanism is not discusses in detail here, however, is generally composed of foot pedals or a tiller which are mechanically linked to the front ice blade.

Figure 1:
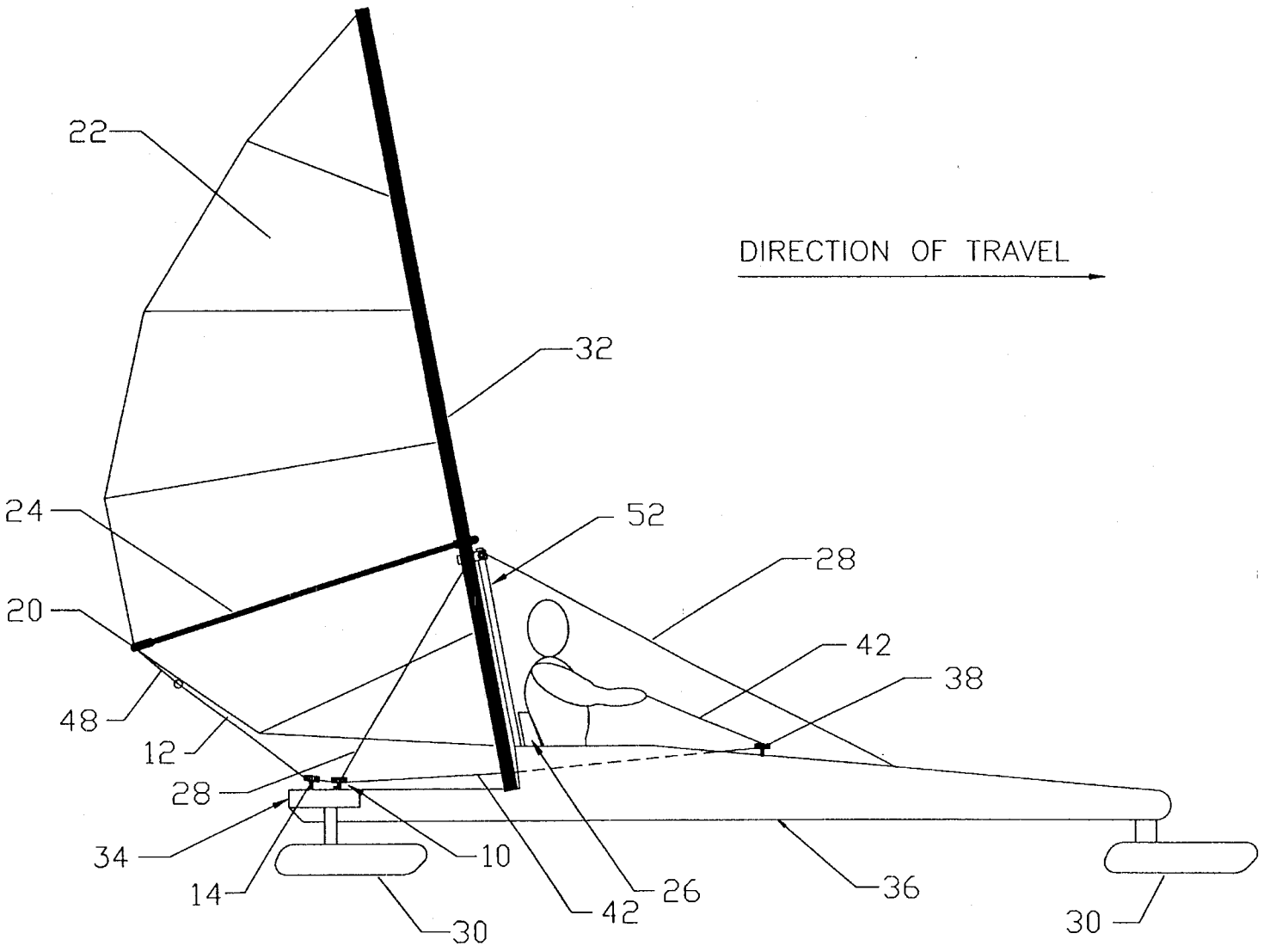
FIG. 1. Side general view of sheeting method used on a rear sail mounted ice boat utilizing a sail board type sail.

FIG. 1 shows a general side view of an ice boat utilizing a sail board type sail. For reference and introduction, a sail board type sail rig is composed of a sail 22, a boom 24 which holds the shape of the sail, a sheeting point 20, and a mast 32. A mast brace 52 aids in rigidly keeping the mast in place, a seat location 26 in front of the sails a vessel main body section 36 (the front of the vessel is to the right in the figure), a main rear body cross beam 34, a set of three ice rails 30 which interface with the ice surface, a set of three guy wires 28 which, along with the mast brace 52, hold the front of the sail (at the mast) rigidly in place. The sheeting mechanism is primarily composed of a center pulley assembly 10, a main sheet line 12, a right sheet adjustment line 48, a secondary sheet line 42, a set of lateral end pulleys 14 which are located at each end of the main rear body crossbeam 34, and a front pulley 38 for directing the secondary sheet rope to the vessel skipper. Other items are introduced in FIG. 2 which cannot be properly seen in FIG. 1. The main sheet line 12, the secondary sheet line 42 and the right side sheet adjustment line 48 could be composed of cable, rope or nylon line. Experience has shown that high quality 1 cm diameter pre-stretched nylon line works well for this application.

From FIG. 1, it can be seen that the sheeting point 20 can extend significantly beyond the end of the ice boat. Guy wires 28, along with the mast brace 52, hold the sail board type sail rigidly in-place at the mast 32 just below the boom front, thus allowing the rear to rotate.

Figure 2:
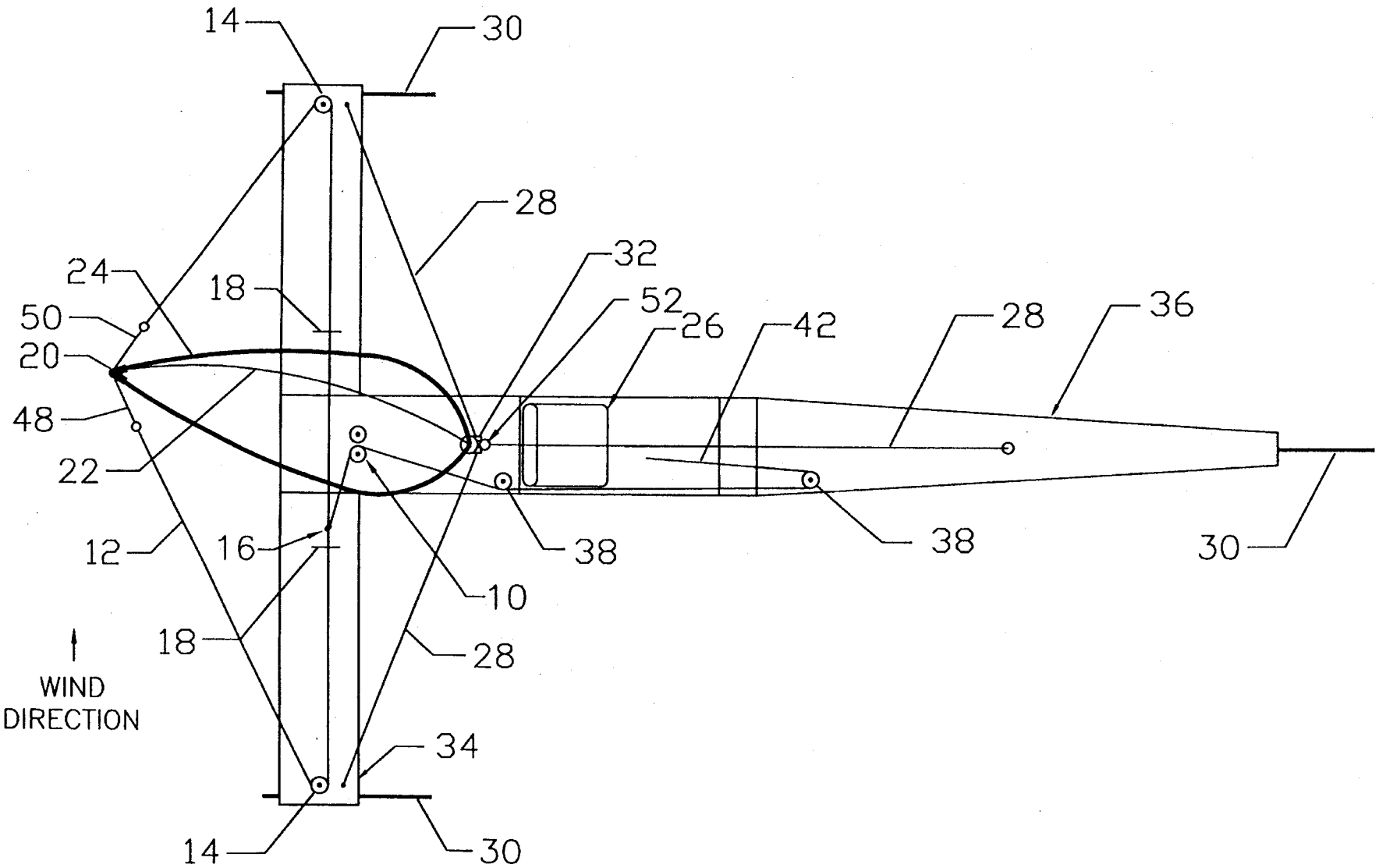
FIG. 2. Top view showing lateral sheeting method with 1:1 leverage.

FIG. 2 shows a top view of ice boat. The new items introduced in this figure are a main-secondary sheet attachment point 16 where the main sheet line 12 attaches to the secondary sheet line 42, and a set of sheet line guides 18. Also shown in this figure is a left side sheet adjustment line 50 which is similar to the right side sheet adjustment line 48. The apparatus for lateral sheeting is composed of items 10, 12, 14, 16, 38, 42, 48, and 50.

Referring to FIG. 2, a center pulley assembly is shown by 10. This is constructed'such that a secondary sheet line 42 is confined between the two pulleys in such a way that the secondary sheet line can be freely pulled in and out. This is done by close but hot touching proximity of two center pulleys. The secondary sheet line 42 is attached to a main sheet line 12 at the main-secondary sheet attachment point 16. This attachment point is large enough that it will not fit through the center pulley assembly 10, thus limiting the travel of both the main sheet and secondary sheet lines 12, 42. A set of lateral end pulley's 14 direct the main sheet line 14 and are located near the ends of the main rear body cross beam 34, The main sheet line 12 is attached to the sheet adjustment lines 48 and 50. The sheet adjustment lines are then attached to the sheeting point 20. Finally, the secondary sheet line travels up to the front of the vessel by means of the front pulleys 38 which give the vessel skipper hand access to the secondary sheet line 42. A set of sheet line guides 18 keep the secondary sheet line 42 from binding during a change in direction or wind shift.

While a pulley is referred to here, any means for guiding and re-directing the line will work. Experience has shown that ball bearing pulleys designed for sail boats work well.

The purpose of the right and left sheet adjustment lines 48 and 50 are to allow precise centering of the sail during full sheet in. This is done in an initial set-up alignment process each time the vessel is used by first pointing the vessel straight into the wind, then pulling the secondary sheet rope such that the main-secondary sheet attachment point 16 is at its full limit at the center pulley assembly 10. Then the vessel operator stands behind the vessel and adjust the length of both right and left sheet adjustment lines 48 and 50 such that the sail is lined up parallel with the center line of the vessel. After adjustment, the left and right sheet adjustment lines 48 and 50 are secured so that they cannot slip during use of the vessel.

Figures 3, 3A:
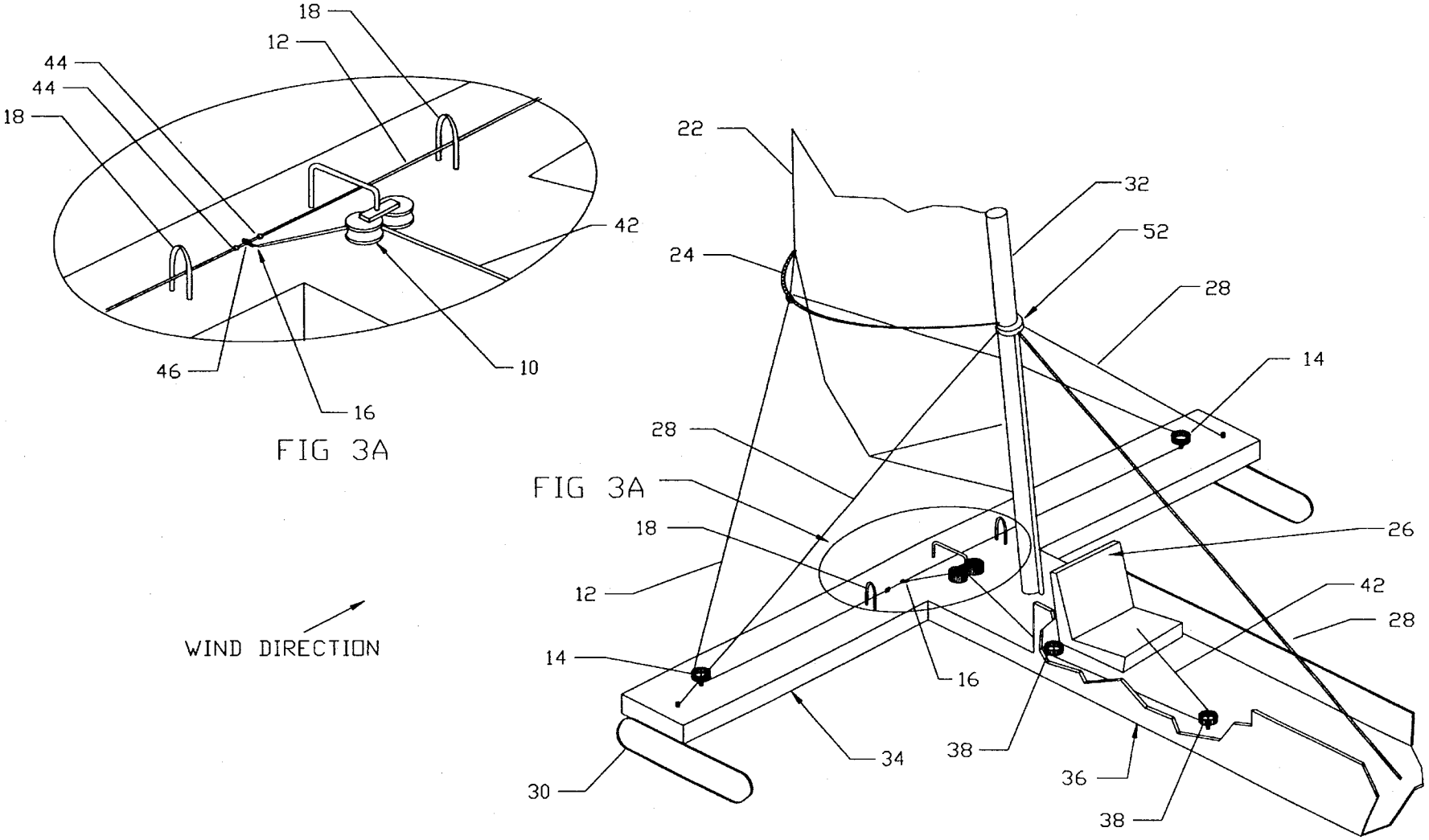
FIG. 3. Side/front view showing sheeting apparatus in detail.
FIG. 3A. Detail of section in FIG. 3 showing main and secondary sheet line attachment points.

FIG. 3 is a side-front view of the sheeting mechanism of the example ice boat. Several new items are introduced in this figure. Specifically, the details of the main-secondary sheet attachment point 16 are shown. A set of knots 44 in the main sheet line 12 confine a secondary sheet line loop 46 between the knots. The secondary sheet line loop 46 is at one end of the secondary sheet line 42.

FIG. 3A shows details of the center pulley assembly 10 and the main-secondary sheet attachment point 16. In FIG. 3A, the main-secondary sheet attachment point 16 is broken down into more detail. In this example, two knots 44 in the main sheet line 12 very economically confine the secondary sheet loop 46 at the end of the secondary sheet line 42 yet still allow the two lines to rotate with respect to each other. This eliminates tangles from occurring. During transitions from one tack to the other, the secondary sheet line 42 becomes loose and the three sheet line guides 18 keep the secondary sheet line 42 from entangling.

Figure 4:
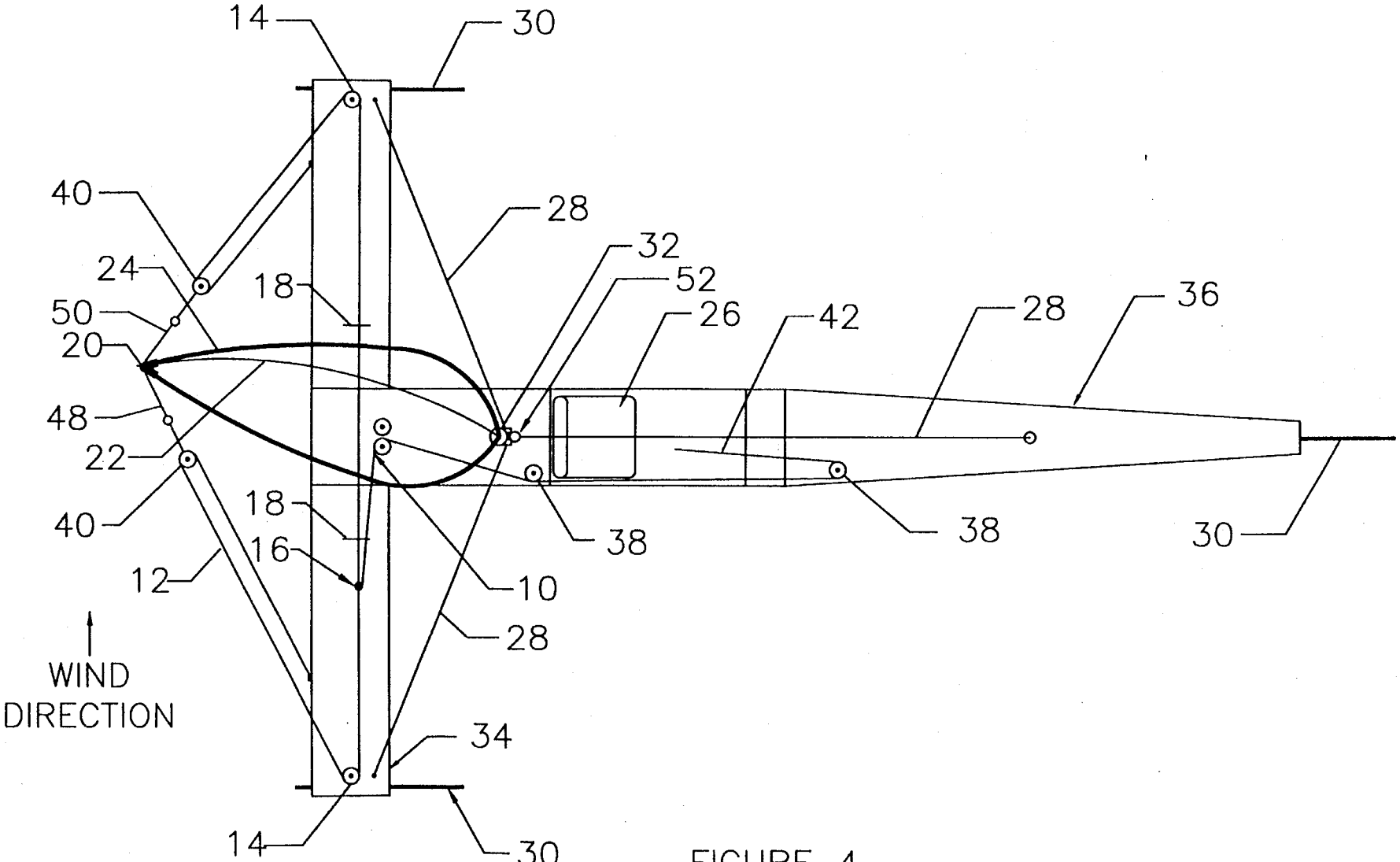
FIG. 4. Top view showing lateral sheeting method with a 2:1 leverage.

FIG. 4 is very similar to FIG. 2 however, includes a set of rear pulleys 40 which implement a 2:1 leverage. In this case, the main sheet line 12 is not attached at the boom end through the left and right sheet adjustment lines 48 and 50 as in FIG. 2, but instead, loop through the rear pulleys 40 and then attach at a rigid point on the main rear body cross beam near the lateral end pulleys 14. The rear pulley's 40 are then attached to the left and right sheet adjustment lines 48, 50; and the sail alignment process is done as described earlier by adjusting the length of the left and right sheet adjustment lines 48 and 50 until the sail is lined up parallel with the center line of the vessel at full sheet, The addition of the rear pulleys 40 allows less force to be exerted by the skipper for sheeting the sail. This is because with the rear pulleys, a 1 unit linear movement in the secondary sheet line results in only a ½ unit linear movement in the sail boom end. For a vessel such as described in this specification, a 2:1 leverage is optimum. However, even higher leverage can be obtained by adding additional pulleys in the same manner.

Figure 5:
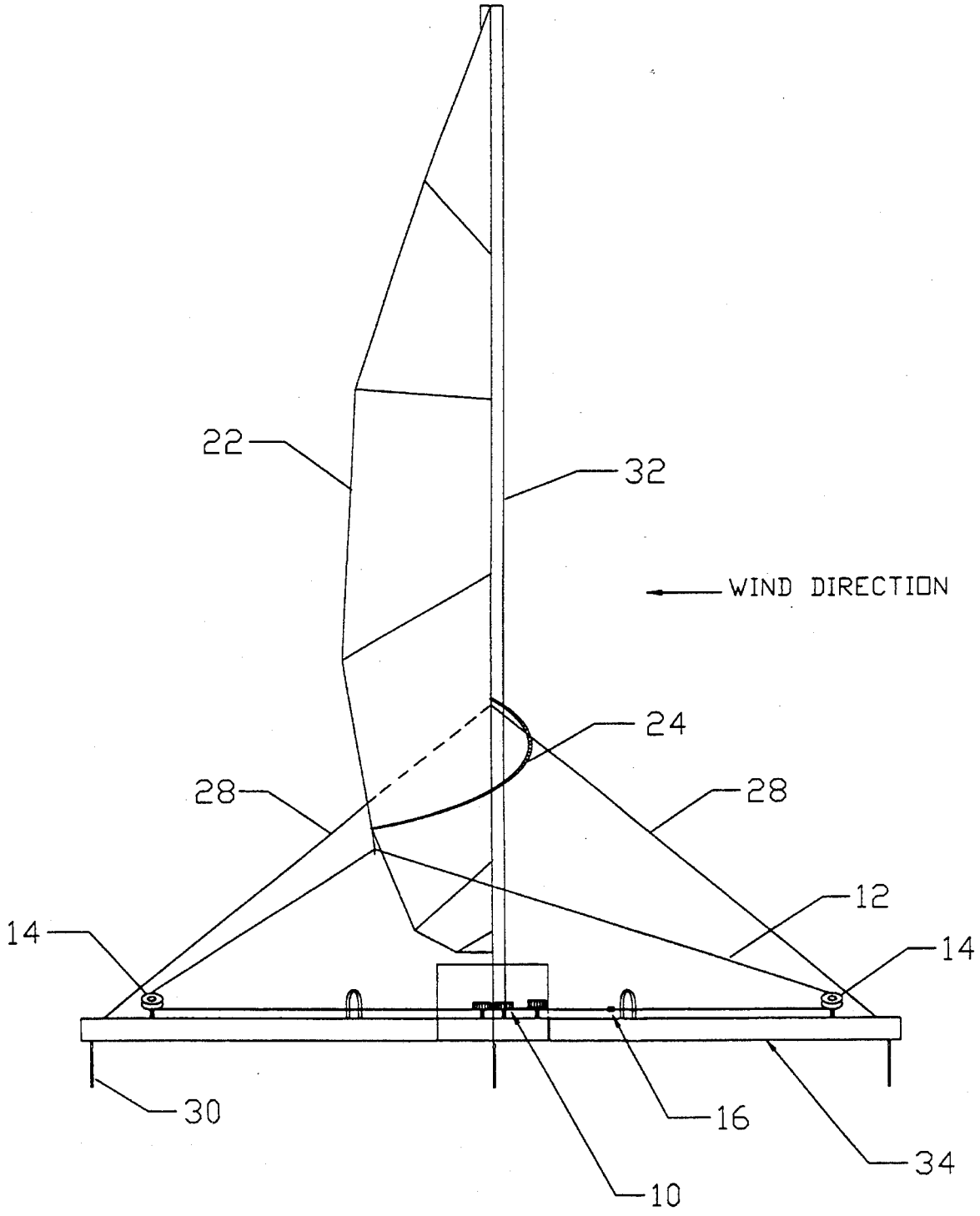
FIG. 5. Rear general view of lateral sheeting method used on a rear sail mounted ice boat.

FIG. 5 is a rear view of the ice boat using a 1:1 pulley arrangement. This figure has no new items and is included to further aid understanding of the structure and operation of this invention.

OPERATION OF THE INVENTION IN THE PREFERRED EMBODIMENT

FIGS. 2 and 3 are primarily used to illustrate the operation of the invention. FIG. 2 is a top view, and for this illustration, the wind is blowing from the bottom of the figure to the top. FIG. 3 is top-side view and the illustrated wind in this figure is blowing towards the upper right hand corner. In both figures, this puts a force on the sail 22 which tends to move the sheeting point 20 towards the top of the page. This pulls the main sheet line 12 in such a way that it would rotate clockwise. The secondary sheet line 42 will be pulled by this rotation as it is connected to the main-secondary sheet attachment point 16 until the secondary sheet line becomes taut. At this point, the rotation of the sail and main sheet line 12 stops. The distance traveled by the main-secondary sheet attachment point 16 from the center pulley assembly 10 is determined by how far the secondary sheet line 42 has been let out by the vessel skipper. If the vessel skipper then pulls on the secondary sheet line 42, the main-secondary sheet attachment point 16 moves towards the center pulley assembly 10 which results in the sheeting point 20 sheeting into the wind and increasing power to the sail. On the other hand, if the skipper releases the secondary sheet line, the main-secondary sheet attachment point 16 moves away from the center pulley's and the sail sheets out spilling wind and de-powering the sail.

FIG. 3A shows finer detail of the main-secondary sheet attachment point 16. From this figure, it can be seen that the loop 46 in the secondary sheet line 42 will move between the two knots 44 in the main sheet line 12 until it runs up against the knot closest to the center pulley assembly 10. The knots 44 are close together so that the movement is small. Further pull on the secondary sheet line 42 then moves the main sheet line 12 because the loop 46 in the secondary sheet line is smaller than the knot 44 and will not pass over. However, the loop 46 is large enough to allow the main sheet line to rotate inside the loop in order to prevent binding.

Referring again to FIGS. 2 and 3, during a tack change of the vessel, the wind direction will change from one side of the vessel to the other. This causes the sail to rotate resulting in the main-secondary sheet attachment point 16 moving in a linear path as the sail rotates from one side of the vessel to the other. If the position of the secondary sheet line 42 is maintained by the skipper, the main-secondary sheet attachment point will move to the exact opposite side of the center pulley assembly 10. Once on the opposite tacks the secondary sheet line 42 has the identical operation as on the initial tack. In other words, regardless of whether the connection point is to the right or left of the center pulley assembly 10, a pull on the secondary sheet line 42 always pulls the main-secondary sheet attachment point 16 towards the center. This then results in the sheeting point 20 always being pulled to center. Pulling the secondary sheet rope sheets in the sail. Releasing the secondary sheet rope un-sheets the sail. This is regardless of which tack of the vessel or wind direction.

During a direction change of the vessel, the sail will flip from one side to the other. During this time, the secondary sheet line 42 between the main-secondary sheet attachment point 16 and the center pulley assembly 10 becomes lax as the main sheet line 12 rotates and the main-secondary sheet attachment point 16 moves past the center pulley assembly 10 to the other side of the vessel. During this transition, sheet line guides 18 keep the secondary sheet line from catching or binding.

FIG. 4 shows an extra set of rear pulleys 40 attached to the sheeting point 20 through the left and right sheet adjustment lines 48, 50. The main sheet line 12 routes through the pulleys and is then attached on the main rear body cross beam 34 near the two ends. The operation of the sheet is identical to that described for FIGS. 2 and 3, however, the extra set of pulleys allow the sheeting point 20 to move one half the distance that the main-secondary sheet attachment point 16 moves. This gives a 2:1 leverage of the sheeting action. Note that multiple pulleys could be used here to further increase the leverage.

FIG. 5 shows the rear view. For this illustration, the wind is blowing from the right side of the figure to the left. Therefore, the sheeting force from the main sheet line 12 is coming from the right side of the vessel. From this figure, it can be seen that the distance from the center of the vessel to the lateral sheet pulley can be used to control both the lateral and downward forces on the sail during sheeting. A larger distance from the center to the lateral end pulley 14 increases the lateral force and decreases the downward force. A shorter distance increases the downward force and decreases the lateral force. In this manner, the forces can be fine tuned for optimum performance.

Thus, the reader can see that the method and apparatus described in this specification has both cost and performance advantages over the prior art particularly when using the relatively newly developed sail board type sail in a rigid mounting implementation. The advantages are:

- Sails can be mounted to a vessel in a very cost effective manner as an either expensive of heavy pole is not required to provide the proper sheeting mechanism.
- If the sail is mounted to the rear of the vessel skipper, the length of the vessel can be shorter with inherent weight and utility savings as the boom end of the sail can extend significantly behind any structure of the vessel.
- The lateral and downward sheeting force on the sail can be well controlled by the distance of the lateral sheeting pulleys from the center of the vessel.
- The sail can be sheeted completely to center which allows maximum speed and power from a sail.

While the above description contains many specifics about implementation, these should not be construed as limitations on the scope of the invention, but rather as an exemplification of one preferred embodiment thereof. Many other variations are possible. For example, the description of the invention was based around an ice boat using a sail board type sail. However, this invention could be used with a water craft and even has some advantages in sail trim refinement for conventional type sails (ie, the type of sail found on conventional sail boats).

Accordingly, the scope of the invention should be determined not by the embodiments illustrated, but by the appended claims and the legal equivalents.

The embodiments of the invention for which an exclusive privilege and property right is claimed are defined as follows:

1. An apparatus for sheeting a sail, the sail is rotationally attached to a sail mast mounted along a center line of the length of a vessel body of the sailing vessel, the sail mast being rigidly attached to the vessel body, the apparatus comprising:

a main sheet line wherein opposite ends of said main sheet line are attached to the sail, a portion of a length of said main sheet line received around a first lateral means for guiding and re-directing said main sheet line, said lateral guide means mounted on the vessel body and on opposite sides of the sail; and a secondary sheet line having an end attached to said main sheet line, said secondary sheet line received by a second lateral guide means for guiding and re-directing said secondary sheet line, said second lateral guide means mounted on the vessel body located near the center of the vessel, a portion of a length of said secondary sheet line extending along the length of the sailing vessel such that an opposite end of said secondary sheet line may be controlled by a skipper of the sail vessel;

whereby the skipper; by pulling said secondary sheet line, can operate the movement of said main sheet line and sheet the sail from the right side and the left side of the vessel and move the sail toward a position approaching parallel with the length of the sailing vessel.

2. The apparatus as described in claim 1 wherein the first lateral means for guiding and re-directing the main sheet line is composed of a first right and a first left lateral end pulleys, a portion of the length of said main sheet line is received around said first right and said first left lateral end pulleys.

3. The apparatus as described in claim 2 wherein said second means for guiding and re-directing the secondary sheet line includes a right center pulley and a left center pulley, said right and left center pulleys mounted on the vessel body adjacent to each other, and a portion of said secondary sheet line received and constrained between said right and left center pulleys.

4. The apparatus as described in claim 2 wherein the vessel includes a lateral cross beam extending outwardly from the vessel body, said first right and first left lateral end pulleys mounted on opposite ends of said lateral beam.

5. The apparatus as described in claim 2 wherein leverage pulley means for increasing pulling force are located at each said opposite ends of said main sheet line to increase sheeting forces on the sail.

6. The apparatus as described in claim 1 wherein adjustable length lines are placed between each of said opposite ends of said main sheet line and said sail.

7. An apparatus for sheeting a sail of a sailing vessel, the sail is attached to a sail mast mounted near a center line along the length of the body of the sailing vessel, the vessel including a lateral cross beam extending outwardly from the body of the sailing vessel, the apparatus comprising:

a main sheet line having opposite ends attached to a rear portion of the sail, a portion of a length of said main sheet line received around a right and a left lateral means for guiding and re-directing the line, said right and left means for guiding and re-directing the line are mounted on opposite right and left ends of the lateral beam respectively; and a secondary sheet line having an end attached to said main 'sheet line, said secondary sheet line received and constrained by a centering means for guiding and re-directing the line, said centering means for guiding and re-directing the line mounted on said vessel body near the center line, a portion of said secondary sheet line extends forward along the length of the sailing vessel such that an opposite end of said secondary sheet line may be held by a skipper of the vessel;

whereby the skipper, by pulling the secondary sheet line, can operate the movement of the main sheet line and sheet the sail from the right and the left side of the vessel and move the sail toward a position approaching parallel with the length of the sailing vessel.

8. The apparatus as described in claim 7 wherein said right and left lateral means for guiding and re-directing the main sheet line is composed of a first right and first left end lateral pulleys, a portion of a length of said main sheet line is received around said first right and said first left lateral end pulleys.

9. The apparatus as described in claim 8 wherein said centering means for guiding and re-directing the secondary sheet line includes a right center pulley and a left center pulley, said right and left center pulleys mounted on the vessel body and disposed adjacent to each other and located approximately on opposite sides of the vessel body, a portion of said secondary sheet line received and constrained between said right and left center pulleys.

10. The apparatus as described in claim 7 wherein leverage pulleys configured to increase pulling force are located between the ends of said main sheet line and the sail with the purpose of said leverage pulleys being to increase the leverage of sheeting action of said secondary sheet line on the sail.

11. The apparatus as described in claim 7 wherein adjustable length lines are placed between each of said opposite ends of said main sheet line and said sail, the purpose of said adjustable length lines being to adjust said sail during alignment.

* * * * *